US011425997B1

(12) United States Patent
Fuentes et al.

(10) Patent No.: US 11,425,997 B1
(45) Date of Patent: Aug. 30, 2022

(54) MODULAR RACK ASSEMBLY FOR HOLDING WINE BOTTLES

(71) Applicants: Alberto Jose Fuentes, Delray Beach, FL (US); Juan Jose Perez Foullerat, Torrejon de Ardoz (ES)

(72) Inventors: Alberto Jose Fuentes, Delray Beach, FL (US); Juan Jose Perez Foullerat, Torrejon de Ardoz (ES)

( * ) Notice: Subject to any disclaimer, the term of this patent is extended or adjusted under 35 U.S.C. 154(b) by 0 days.

(21) Appl. No.: 17/351,428

(22) Filed: Jun. 18, 2021

(51) Int. Cl.
*A47B 73/00* (2006.01)
*A47B 43/00* (2006.01)
*A47B 96/14* (2006.01)

(52) U.S. Cl.
CPC ..... *A47B 73/006* (2013.01); *A47B 43/006* (2013.01); *A47B 73/008* (2013.01); *A47B 96/1425* (2013.01); *A47B 2220/0077* (2013.01)

(58) Field of Classification Search
CPC ..... A47F 7/28; A47B 73/006; A47B 43/006; A47B 2220/0077; A47B 43/003; A47B 69/00; A47B 73/00; A47B 73/008; A47B 77/14; A47B 96/1425
USPC ..... 211/74, 75; 312/72, 45, 128
See application file for complete search history.

(56) References Cited

U.S. PATENT DOCUMENTS 488,757 A * 12/1892 Friendlich ..... A47G 25/743 211/113
1,602,771 A * 10/1926 Mitchell ..... A47B 43/006 211/10
1,816,705 A * 7/1931 Arthur ..... A47B 43/006 108/1
1,840,033 A * 1/1932 Hampton ..... A47B 69/00 312/287
2,177,678 A * 10/1939 Uhri, Jr. ..... A47B 57/00 108/106
2,483,043 A * 9/1949 Golden ..... B60N 3/004 280/727
3,025,970 A * 3/1962 Ostrom ..... A47B 43/006 108/99
3,081,972 A * 3/1963 Gray, Jr. ..... G09F 15/0087 108/106
3,221,678 A * 12/1965 Doherty ..... A47B 57/26 108/106
3,327,310 A * 6/1967 Bethune ..... H04N 5/64 343/702
3,479,990 A * 11/1969 Crow ..... A01K 15/024 248/200.1

(Continued)

*Primary Examiner* — Jennifer E. Novosad
(74) *Attorney, Agent, or Firm* — The Keys Law Firm PLLC

(57) ABSTRACT

A modular rack assembly for wine bottles which is formed from one or more frame members which each have a racking body coupled therewith. Each racking body in the assembly includes a plurality suspension cords which extend from a top portion thereof to a bottom portion thereof, and have a plurality of shelves, bottle holders, or other support mechanisms for receiving and holding a bottle, fixed to and dispersed along the suspension cords vertically. A composite modular rack assembly, formed from two or more side by side modular rack assemblies, may include frame members of at least two distinct widths, and the selection of which racking body will be coupled with each frame member allows for the provision of a wide variety of customized configurations through a limited number of modular component parts.

20 Claims, 11 Drawing Sheets

(56) References Cited

U.S. PATENT DOCUMENTS 3,595,209 A * 7/1971 Parker ..... A01K 15/024 248/200.1
3,771,466 A * 11/1973 Ferdinand ..... A47B 57/42 248/200.1
D243,738 S * 3/1977 Johnson ..... D7/704
4,061,092 A * 12/1977 Jacobsen ..... A47B 43/006 52/39
4,129,080 A * 12/1978 Vall ..... A47B 43/006 D6/570
4,265,097 A * 5/1981 Bordas ..... A47B 73/002 62/438
4,295,432 A * 10/1981 Hulke ..... A47B 43/006 D6/514
4,736,855 A * 4/1988 Arakawa ..... A47B 57/567 211/187
4,819,817 A * 4/1989 Mar ..... A47B 96/1425 446/268
4,919,280 A * 4/1990 Phillips ..... A47F 5/08 211/187
4,928,833 A * 5/1990 Huizenga ..... A47B 95/008 211/187
4,998,631 A * 3/1991 Fridjhon ..... A47B 73/002 211/74
5,148,928 A * 9/1992 Arnold ..... A47B 96/06 211/187
5,176,266 A * 1/1993 Gillet ..... A47B 43/006 108/106
5,542,530 A * 8/1996 Freelander ..... A47B 43/003 108/106
5,622,415 A * 4/1997 Felsenthal ..... A47B 43/04 312/3
5,624,169 A * 4/1997 Bishop, Jr. ..... A47B 51/00 312/9.55
5,810,457 A * 9/1998 Felsenthal ..... A47B 57/20 312/351
5,924,469 A * 7/1999 Whittemore ..... E04G 21/30 248/200.1
6,082,560 A * 7/2000 Timm ..... A47B 61/00 211/90.04
6,086,171 A * 7/2000 Ashley ..... A47B 49/00 211/205
6,311,626 B1 * 11/2001 Roberts ..... A47B 43/003 211/113
6,443,319 B1 * 9/2002 Sander ..... A47B 96/1425 211/186
6,595,145 B1 * 7/2003 Lietz ..... A47B 43/006 108/106
6,648,155 B1 * 11/2003 Wang ..... A47B 57/26 211/187
6,681,941 B1 * 1/2004 Johnson ..... A47B 57/00 211/90.04
6,763,956 B2 * 7/2004 Woods ..... A47B 73/00 211/74
7,287,872 B2 * 10/2007 Kubota ..... A47B 43/006 362/418
7,624,479 B1 * 12/2009 Lin ..... F16B 9/058 24/135 N
7,673,409 B2 * 3/2010 Pitcher ..... G09F 7/18 248/65
8,167,152 B1 * 5/2012 Gatti ..... E04B 2/821 211/187
8,276,769 B2 * 10/2012 Hogeback ..... A47F 7/28 211/74
9,060,603 B1 * 6/2015 Christie ..... A47B 43/006
9,669,907 B2 * 6/2017 Field ..... B63B 32/83
9,706,836 B1 * 7/2017 Nelson ..... A47B 57/06
10,172,451 B2 * 1/2019 Mahugo-Lopez ... A47B 43/006
10,334,973 B2 * 7/2019 Slevin-Giesler ..... A47G 1/1653
D856,098 S * 8/2019 Loughran ..... D7/701
2003/0164347 A1 * 9/2003 Bouvier, Jr. ..... B63B 32/83 211/187
2006/0186071 A1 * 8/2006 Rowan ..... A47G 29/00 211/113
2009/0120886 A1 * 5/2009 Weiss ..... A47B 53/02 211/74
2011/0036791 A1 * 2/2011 Huang ..... A47B 73/00 211/74
2013/0032560 A1 * 2/2013 Gregory ..... A47B 47/00 211/153
2013/0181103 A1 * 7/2013 Jette ..... A47B 43/006 248/219.4
2013/0233814 A1 * 9/2013 Gupta ..... A47B 96/066 211/74
2014/0165472 A1 * 6/2014 McLemore ..... A47B 43/006 248/205.2
2019/0313792 A1 * 10/2019 Kusik ..... A47B 73/002

* cited by examiner

MODULAR RACK ASSEMBLY FOR HOLDING WINE BOTTLES

BACKGROUND OF THE INVENTION

Field of the Invention

This invention relates generally to organization and storage systems for bottles and, more particularly, to a modular storage and display assembly for wine bottles.

Description of the Prior Art

The use of wine racks in various forms for the storage, organization, and display of wine bottles is well established. Wine racks are typically defined by a set of shelving that is structured and arranged to hold a plurality of bottles of wine and allow the bottles to be stored thereon and accessed therefrom. While all wine racks may share these fundamental characteristics, there are many types of wine racks known in the art, and wine racks are known to come in many different sizes. For example, wine racks can be in the form of a floor standing structure, a wall mounted structure, a table top structure, a hanging structure, or even a structure that is built into another piece of furniture, and wine racks may be sized to hold anywhere between a few bottles of wine to hundreds of bottles of wine.

While the availability of space and the quantity of wine to be stored are often major considerations in the design of a wine rack, aesthetic considerations, both with the look of the wine rack and the way wine is displayed on the wine rack, also may influence the design of a wine rack. Such considerations have led many to the development of a market for premium wine racks which may be custom built against a wall to hold tens or hundreds of bottles and present them in an aesthetically pleasing manner, oftentimes with aesthetic framing and enhancements such as integrated lighting. As opposed to merely providing storage, such custom-built premium wine racks, and the wine bottles that they hold, oftentimes become a part of the décor of the room in which they are located. Because of this, the importance of the placement and orientation of the shelving extends beyond mere functional concerns and into aesthetics.

A problem which still exists, however, is that with many custom-built premium wine racks, achieving a proper balance of factors like structural integrity, size, and aesthetics requires that each different rack design to be crafted individually in its entirety. Thus, there remains a need for a modular assembly for a wine rack which allows for customized selections on the arrangement of shelving and other aspects of the design within a given customizable frame without any compromise to the structural integrity of any aspect of the assembly. It would additionally be desirable for such a modular wine rack assembly to provide for the coupling and integration of a plurality of discrete customizable frames to enable the size of an assembly to be scaled.

SUMMARY OF THE INVENTION

The present disclosure provides for a modular rack assembly comprising: at least one frame member having a rectangular upper portion, a rectangular lower portion, and four elongated linear frame elements extending from each corner of the upper portion to a corresponding corner of the lower portion; a racking body having an upper mounting member, a lower mounting member, and a plurality of suspension cords extending vertically between the upper mounting member and the lower mounting member, wherein said racking body is fixed to said at least one frame member with the upper mounting member fastened to the upper portion and the lower mounting member fastened to the lower portion such that each of the suspension cords are taut between the upper mounting member and the lower mounting member; and a plurality of mechanical supports suitable for holding bottles of wine, wherein each of the plurality of mechanical supports is integral with at least one of the plurality of suspension cords and the plurality of mechanical supports are distributed along the plurality of suspension cords on a plurality of horizontal planes.

It is an object of the present disclosure to provide a modular rack assembly which allows for customized selections on the arrangement of shelving and other aspects of the design within a given customizable frame without any compromise to the structural integrity of any aspect of the assembly.

It is an additional object of the present disclosure to provide a modular wine rack assembly which provides for the coupling and integration of a plurality of discrete customizable frames to enable the size of an assembly to be scaled.

DETAILED DESCRIPTION OF THE INVENTION

Described herein is a modular rack assembly for wine bottles which is formed from one or more frame members which each have a racking body coupled therewith, and a method for assembling such a modular rack assembly. Each racking body in the assembly includes a plurality suspension cords which extend from a top portion thereof to a bottom portion thereof, and have a plurality of shelves, bottle holders, or other support mechanisms for receiving and holding a bottle, fixed to and dispersed along the suspension cords vertically. A modular rack assembly may include frame members of at least two distinct widths, and the selection of which racking body will be coupled with each frame member allows for the provision of a wide variety of customized configurations through a limited number of modular component parts.

Figure 1:
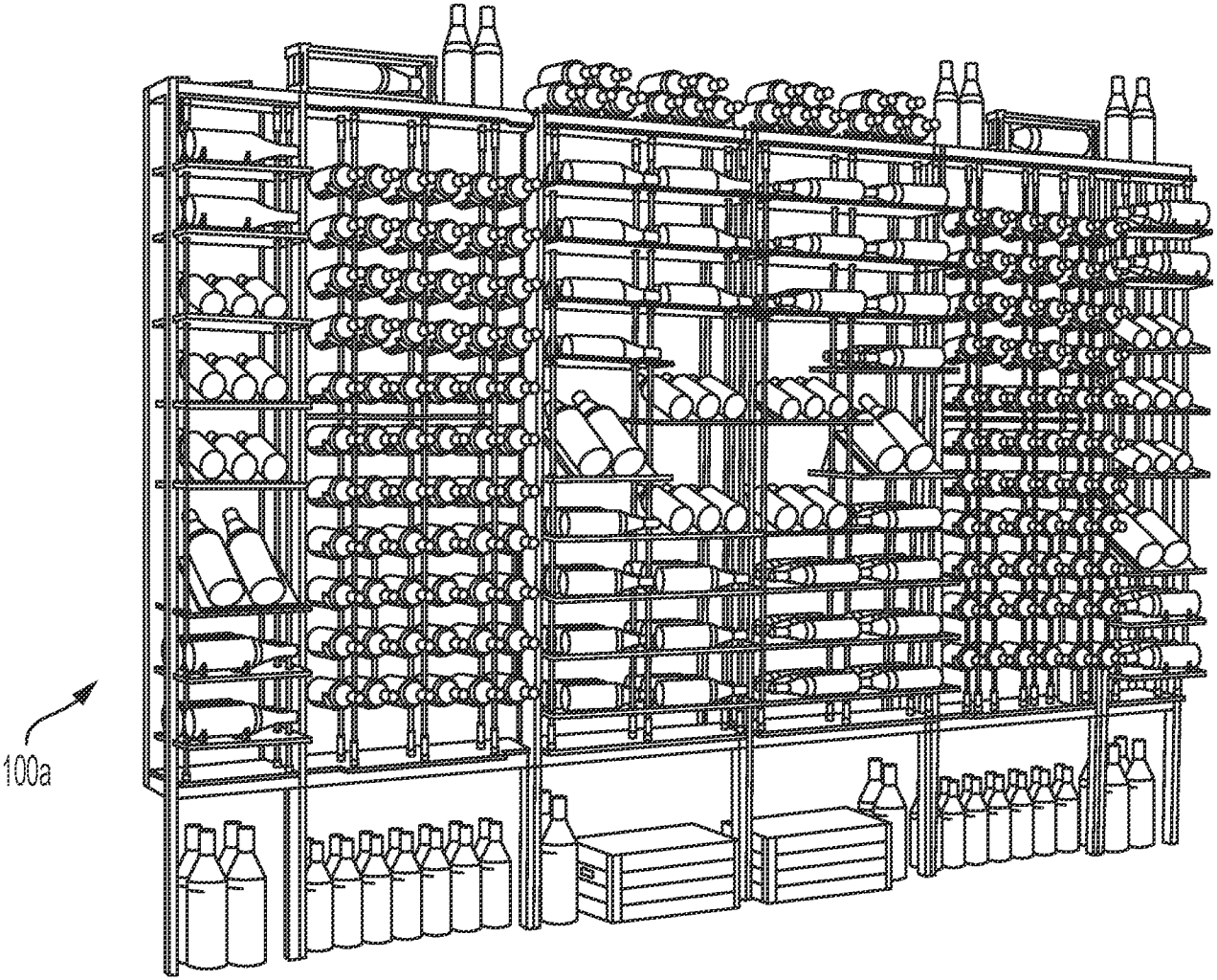
FIG. 1 is a front perspective view of a modular rack assembly for wine bottles built in accordance with the present invention, shown in a first composite configuration.
Figure 2:
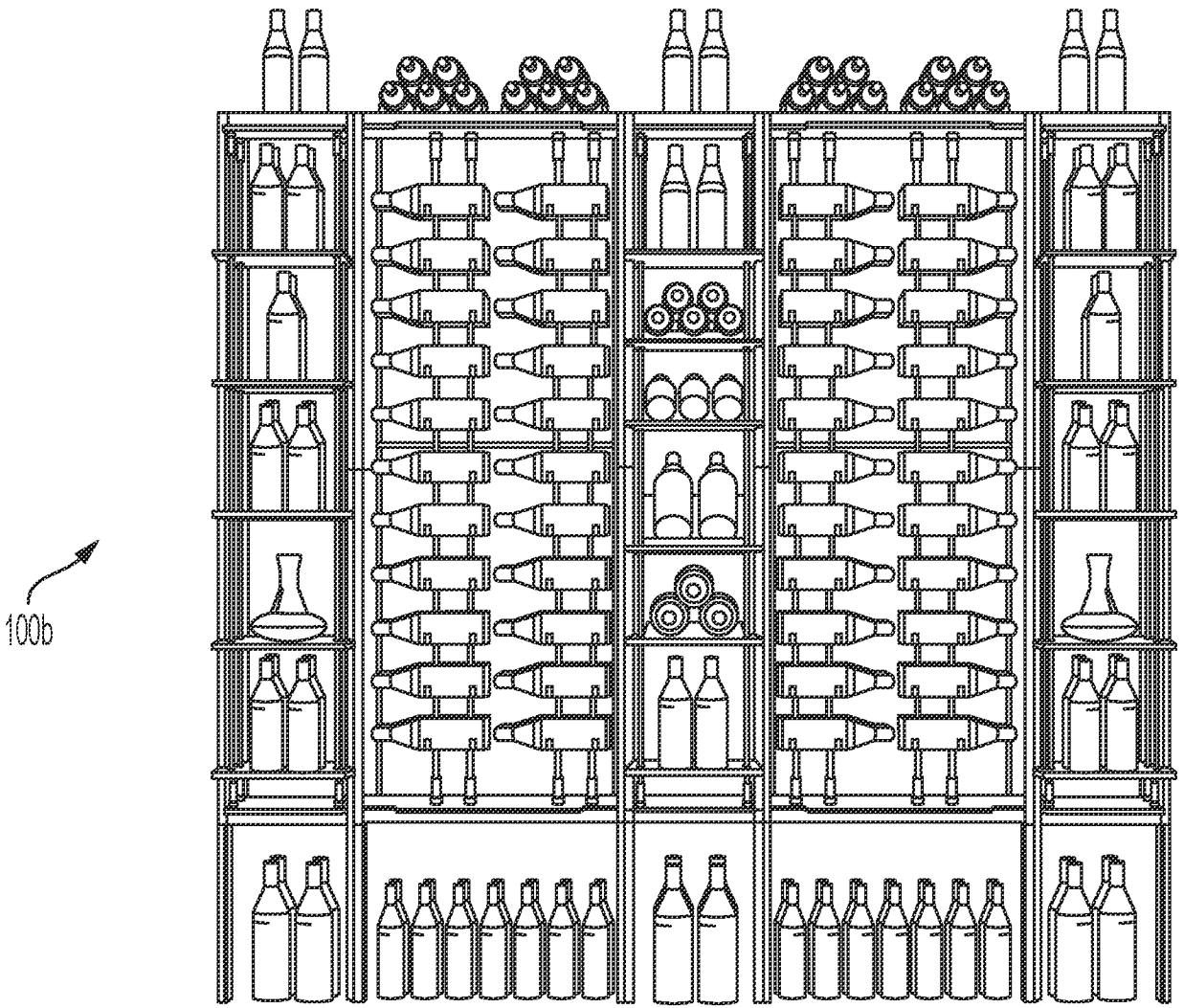
FIG. 2 is a front elevational view of a modular rack assembly for wine bottles built in accordance with the present invention, shown in a second composite configuration.
Figure 3:
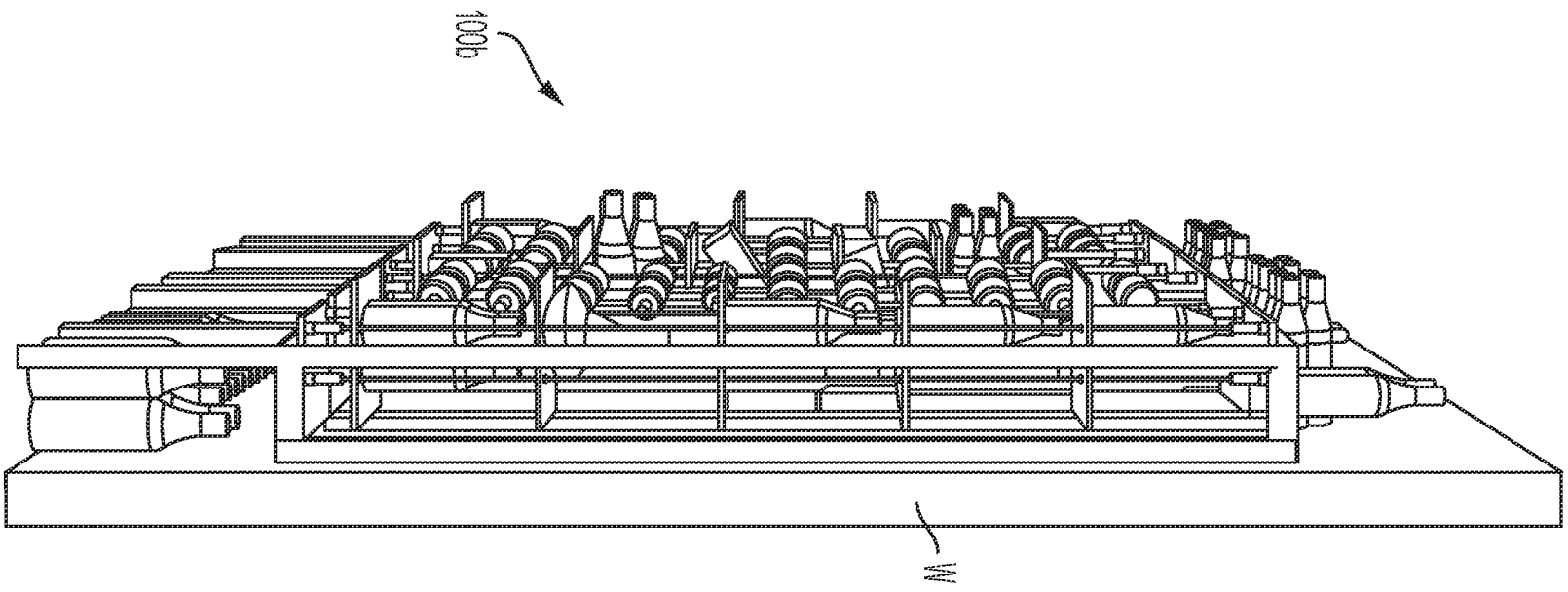
FIG. 3 is a side perspective view of a modular rack assembly for wine bottles built in accordance with the present invention, shown in a second composite configuration.

Referring now to the drawings and, in particular, FIGS. 1, 2, and 3, two designs of a composite modular rack assembly 100*a*, 100*b* (collectively, 100) for wine bottles are shown, each having a plurality of wine bottles stored thereon. Shown in FIG. 1 is a composite modular rack assembly design 100*a* which includes six (6) total modular rack assemblies, four wide frame members positioned side by side, with two narrow frame members bookending the structure. Shown in FIGS. 2 and 3 is a composite modular rack assembly design 100*b* which includes five (5) total modular rack assemblies, three narrow frame members and two wide frame members, with the narrow and wide frame members arranged so as to alternate between the two sizes. When in use, the composite modular rack assemblies 100, or any of the component modular rack assemblies thereof, may desirably be installed against a wall W.

For each of the modular rack assemblies, the frame members each include a racking body integrated therewith. As discussed in greater detail below, each racking body includes the shelving or hooks on which bottles of wine can be placed and from which such bottles can be displayed. In this regard, the combination of either a wide frame member or a narrow frame member with a correspondingly sized racking body forms a structure suitable for the storage and display of bottles of wine. Furthermore, the coupling of a plurality wide frame members and/or narrow frame members allows for the provision of a modular rack assembly which is customizable in both size and in how wine bottles can be stored and displayed.

Figure 4A:
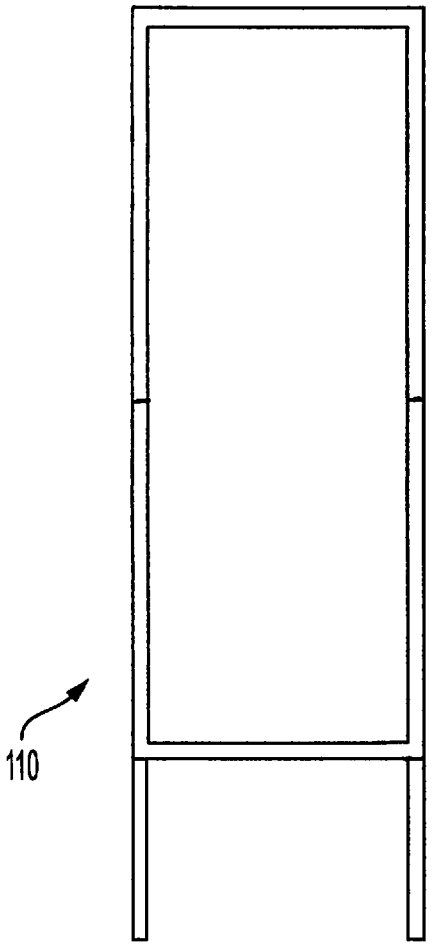
FIG. 4*a* is a front elevational view of a wide frame member of a modular rack assembly for wine bottles built in accordance with the present invention.
Figure 4B:
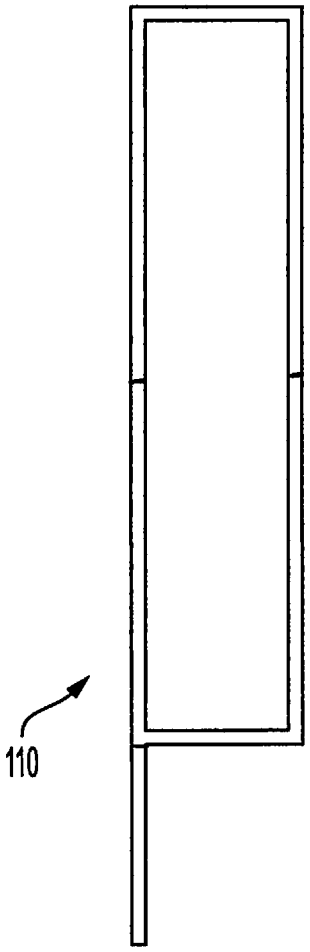
FIG. 4*b* is a side elevational view of a wide frame member of a modular rack assembly for wine bottles built in accordance with the present invention.
Figure 4C:
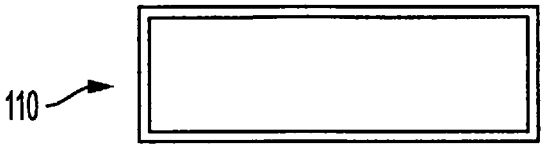
FIG. 4*c* is a top plan view of a wide frame member of a modular rack assembly for wine bottles built in accordance with the present invention.

Referring now to FIGS. 4*a*, 4*b*, and 4*c*, a wide frame member 110 is shown having a rectangular prism shaped portion and a pair of support legs. The rectangular prism shaped portion of the wide frame member 110 is substantially open, with its structural outline formed from frame elements which extend between each of the eight (8) corners of the portion in a manner which causes the frame elements to surround each side of the rectangular prism. Each frame element may be defined as a rigid tubular member which may be constructed out of aluminum. The rectangular prism shaped portion of the wide frame member 110 may be formed of two U shaped profile parts which have been coupled together with their open ends facing one another to create the rectangular profile. The two support legs may also be formed from rigid elements and extend downward from each of the two front bottom corners of the wide frame member 110.

Figure 5A:
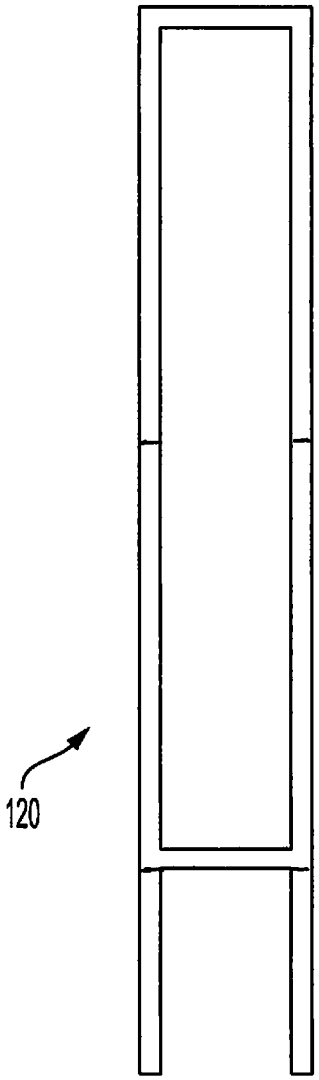
FIG. 5*a* is a front elevational view of a narrow frame member of a modular rack assembly for wine bottles built in accordance with the present invention.
Figure 5B:
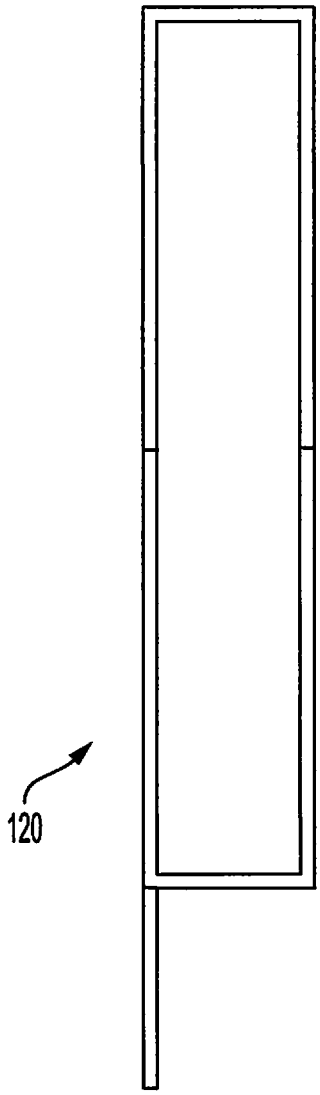
FIG. 5*b* is a side elevational view of a narrow frame member of a modular rack assembly for wine bottles built in accordance with the present invention.
Figure 5C:
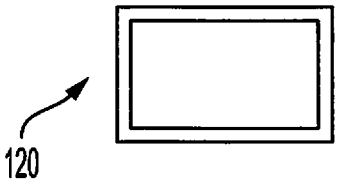
FIG. 5*c* is a top plan view of a narrow frame member of a modular rack assembly for wine bottles built in accordance with the present invention.
Figure 6A:
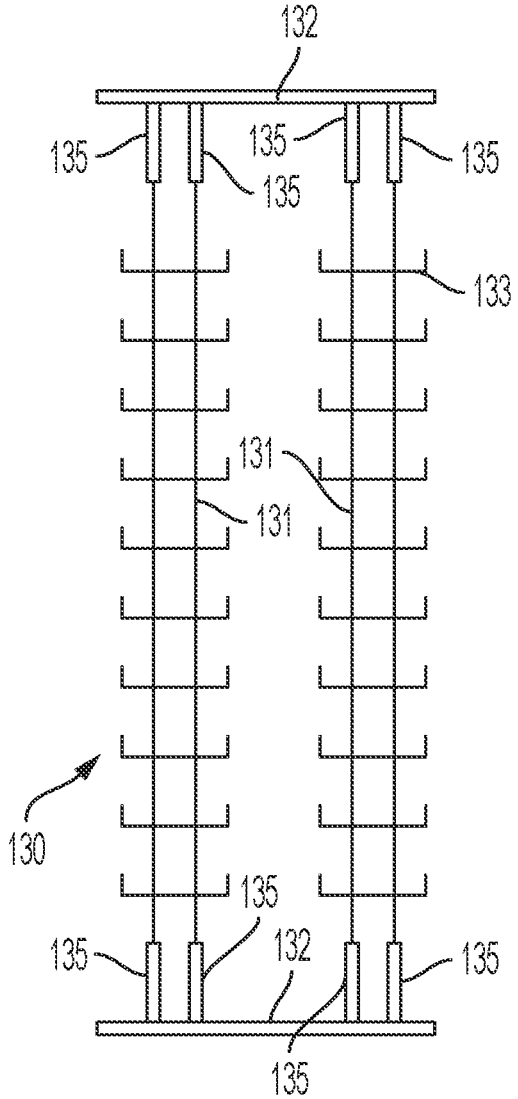
FIG. 6*a* is a front elevational view of a first embodiment of a wide racking body of a modular rack assembly for wine bottles built in accordance with the present invention.

Referring now to FIGS. 5*a*, 5*b*, and 5*c*, a narrow frame member 120 is shown having a rectangular prism shaped portion and a pair of support legs. The narrow frame member 120 may be structured in substantially the same manner and the wide frame member 110, with the exception that the wide frame member 110 may be twice as wide and the narrow frame member 120. In this regard, the rectangular prism shaped portion of the narrow frame member 120 substantially open, with its structural outline simply formed from rigid frame elements which extend between each of the eight (8) corners of the portion in a manner which causes the frame elements to surround each side of the rectangular prism. The two support legs may also be formed from rigid elements and extend downward from each of the two front bottom corners of the narrow frame member 120.

Referring now to FIGS. 6*a*, 6*b*, 7*a*, and 7*b*, a first embodiment of a wide racking body 130 is shown having a four suspension cords 131 which extend between a pair of mounting boards 132. The suspension cords 131 may be constructed of a wire rope and the mounting boards 132 may be each constructed of a rigid material such as aluminum or another metal. It is appreciated that the suspension cords 131 may be sized such that when one mounting board 132 is attached to an upper portion of a wide frame member 110 and the other is attached to the lower portion of a wide frame member 110, the suspension cords 131 will be taut. Each end of each suspension cord 131 may be attached to one of the mounting boards 132 through cord connector 135. It is contemplated that it may be desirable to selectively increase or decrease the tension of the suspension cords 131, and that the cord connectors 135 may have a threaded interior and clamping system which allows for such adjustments to be made.

Figure 7A:
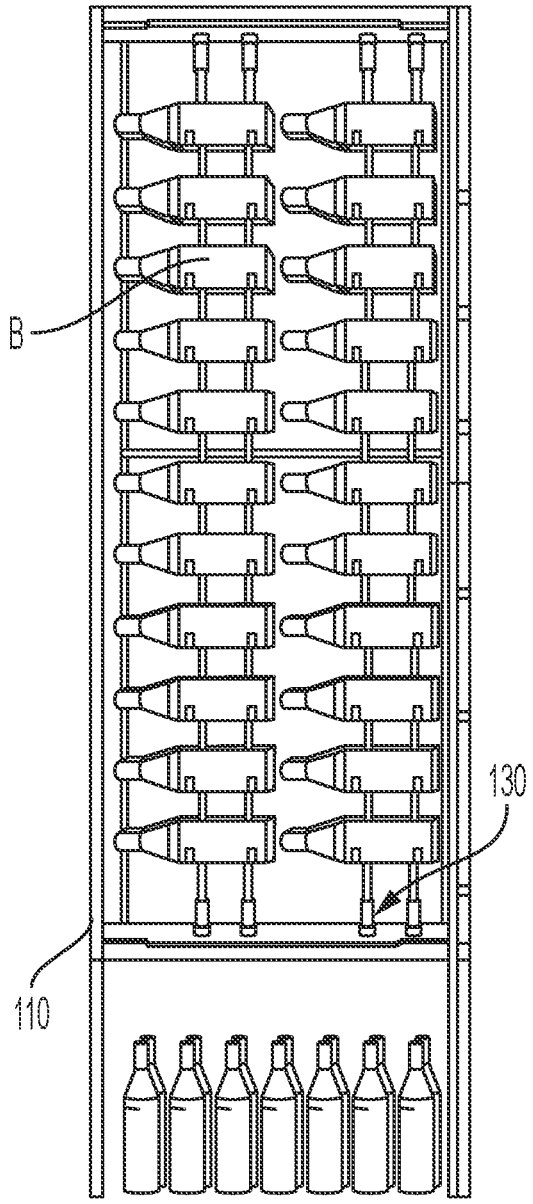
FIG. 7*a* is a front elevational view of the combined first embodiment of a wide racking body and wide frame member of a modular rack assembly for wine bottles built in accordance with the present invention.
Figure 6B:
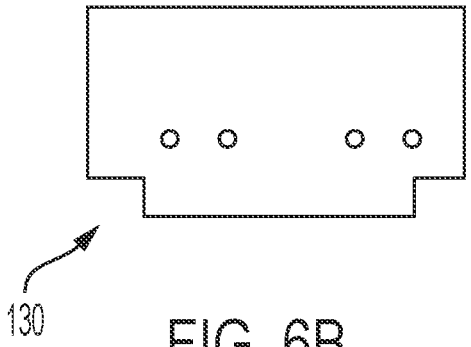
FIG. 6*b* is a top plan view of a first embodiment of a wide racking body of a modular rack assembly for wine bottles built in accordance with the present invention.
Figure 7B:
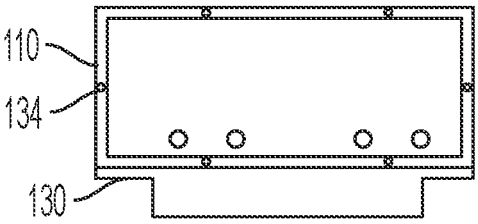
FIG. 7*b* is a bottom plan view of the combined first embodiment of a wide racking body and wide frame member of a modular rack assembly for wine bottles built in accordance with the present invention

Attached to each suspension cord 131 is a plurality of bottle supports 133 which are suitable to receive and hold a bottle, such as a bottle of wine B (as illustrated in FIG. 7*a*). It is contemplated that the bottle supports 133 may be selectively fixed in place through a conventional stop sleeve (not shown) that has been crimped in place directly beneath where each bottle supports 133 is desired to be placed. It is appreciated, however, that alternate stopping mechanisms for a wire rope, such as allen sleeves, may be employed to allow the bottle supports 133 to be fixed in a desired vertical disposition along the suspension cord 131 (or across two suspension cords 131).

The wide racking body 130 may be installed in the wide frame member 110, as shown in FIG. 7, by fastening one of the mounting boards 132 of the wide racking body 130 to the upper portion of the wide frame member 110 and fastening the other mounting board 132 of the same wide racking body 130 to the lower portion of the wide frame member 110. In accordance with the present invention, this fastening is done with both the mounting board 132 that fastens to the upper portion of the wide frame member 110 and the mounting board 132 that fastens to the lower portion of the wide frame member 110 fixed to the interior surface of the wide frame member 110 so that the wide racking body 130 spans the entire interior of the wide frame member 110 longitudinally.

It is contemplated that the mounting boards 132 may be fastened to the wide frame member 110 through a plurality of elongated mechanical fasteners 134, such as screws or bolts.

Figure 8:
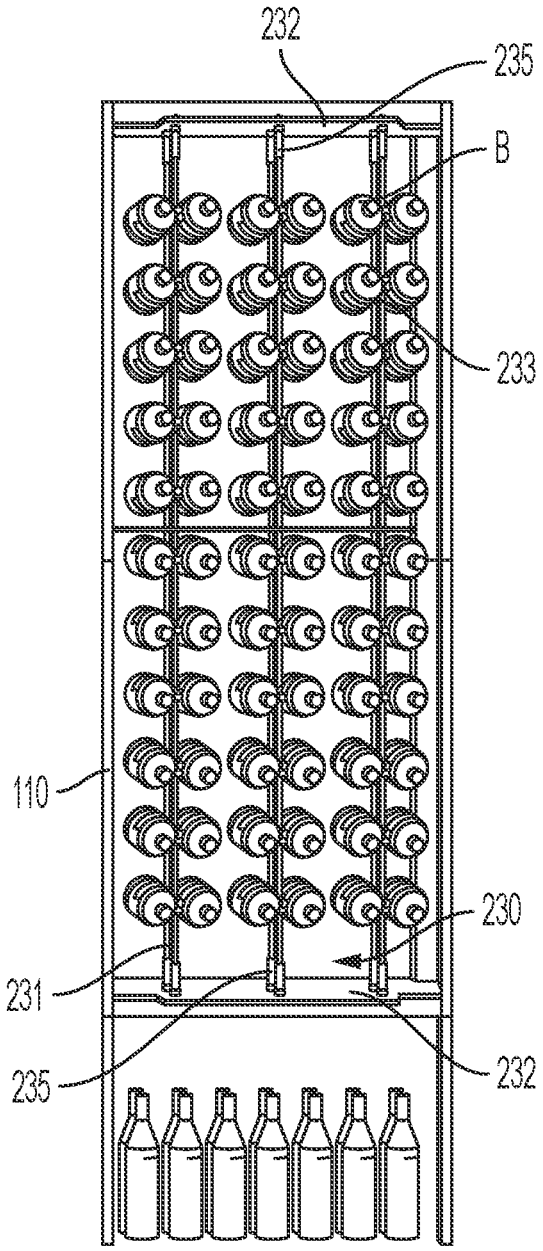
FIG. 8 is a front elevational view of the combined second embodiment of a wide racking body and wide frame member of a modular rack assembly for wine bottles built in accordance with the present invention.

Referring now to FIG. 8, a second embodiment of a wide racking body 230 is shown fastened to a wide frame member 110. Similar to the first embodiment, the second embodiment of a wide racking body 230 includes multiple suspension cords 231 which extend between a pair of mounting boards 232 and are coupled therewith with cord connectors 235. The second embodiment of a wide racking body 230 includes six (6) suspension cords 231, each having connected thereto a plurality of bottle supports 233 which are suitable to receive and hold a bottle, such as a bottle of wine B. The materials of the second embodiment of a wide racking body 230, and the manner in which it is fastened to the wide frame member 110, may be analogous to that of the first embodiment, with the primary difference between the two embodiments is the type and number of bottle supports 233 and the orientation which these bottle supports 233 hold bottles of wine B. In this regard, the second embodiment of a wide racking body 230 provides a customization option for the modular rack assembly built in accordance with the present invention that uses the identical wide frame member 110.

Figure 9:
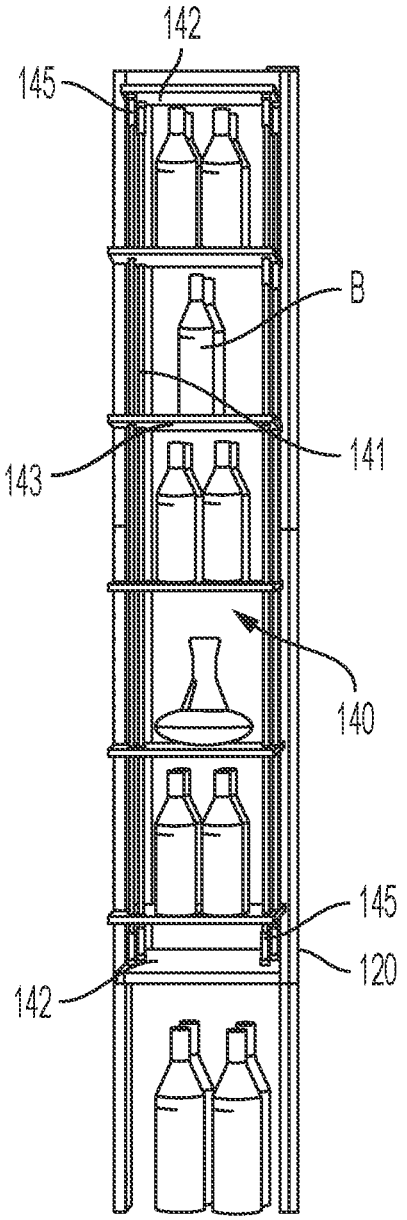
FIG. 9 is a front elevational view of the combined narrow racking body and narrow frame member of a modular rack assembly for wine bottles built in accordance with the present invention.

Referring now to FIG. 9, an embodiment of a narrow racking body 140 is shown fastened to a narrow frame member 120. Similar to the embodiments of the wide racking body, the narrow racking body 140 includes multiple suspension cords 141 which extend between a pair of mounting boards 142 and are coupled therewith with cord connectors 145. The narrow racking body 140 includes four (4) suspension cords 141, each having connected thereto a plurality of bottle supports 143 which are suitable to receive and hold a bottle, such as a bottle of wine B. In illustrated the embodiment of the narrow racking body 140, the bottle supports 143 are defined by planar shelves.

The materials of the narrow racking body 140, and the manner in which it is fastened to the narrow frame member 120, may be analogous to that of the embodiments of the wide racking body, with the primary difference between the embodiments of the wide racking body is the lateral width of the narrow racking body 140 and narrow frame member 120, as well as the type and number of bottle supports 143 and the orientation which these bottle supports 143 hold bottles of wine B. In this regard, the narrow racking body 140 provides additional customization options for the modular rack assembly built in accordance with the present invention for both the total size of the assembly as well as providing for more visual variance while still employing a frame that be positioned next to and coupled with one or multiple wide frame members 110.

Figure 10:
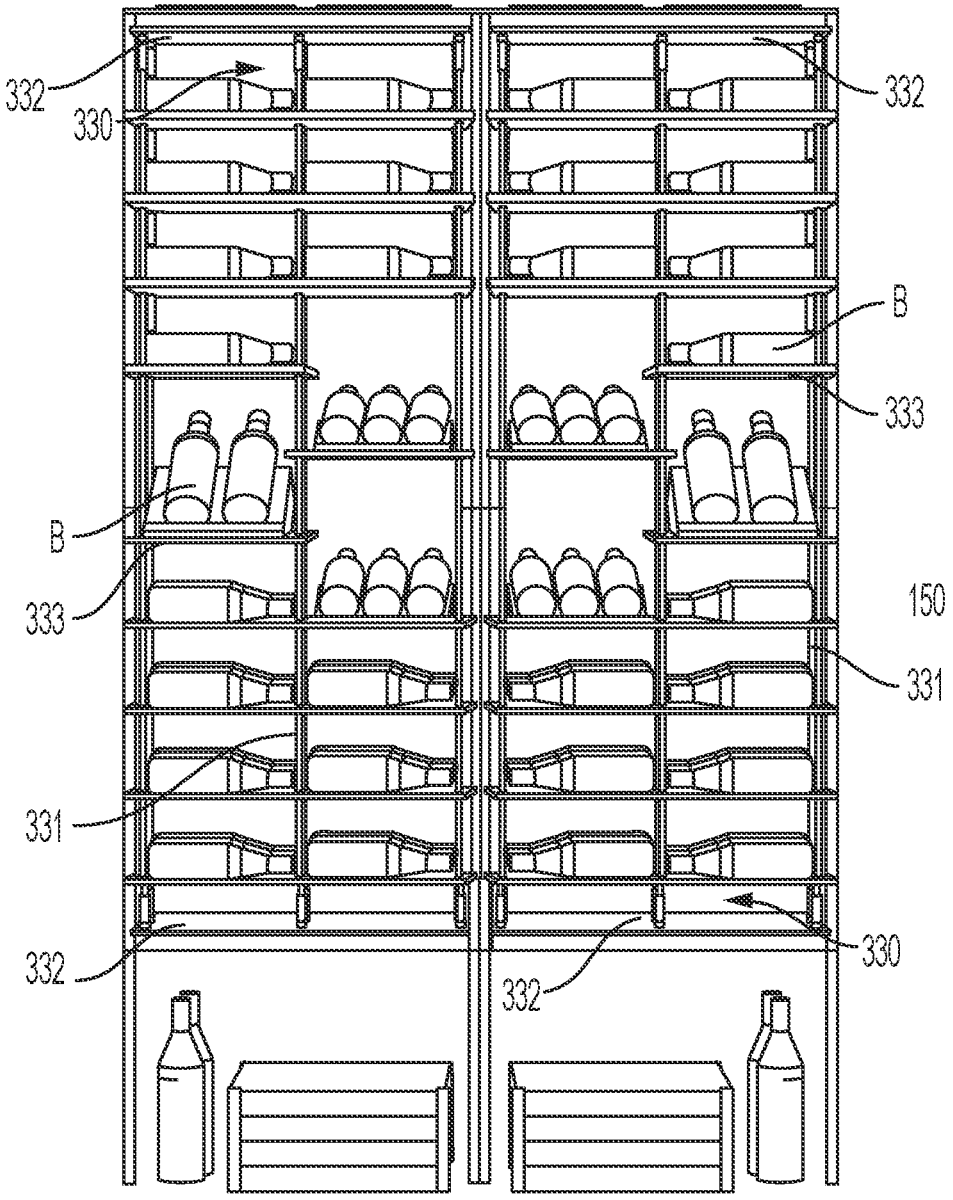
FIG. 10 is a front elevational view of two combined third embodiment of a wide racking body and wide frame member of a modular rack assembly for wine bottles built in accordance with the present invention, shown coupled together.

Referring now to FIG. 10, two discrete wide racking bodies 330 and wide frame members 110 are shown side by side, with each of the wide racking bodies 330 being built in accordance with a third embodiment of a wide racking body 330 and being fastened to one of the wide frame members 110. Similar to the first and second embodiments, the third embodiment of a wide racking body 330 includes multiple suspension cords 331 which extend between a pair of mounting boards 332. The third embodiment of a wide racking body 330 also includes six (6) suspension cords 331, each having connected thereto a plurality of bottle supports 333 which are suitable to receive and hold a bottle, such as a bottle of wine B. The materials of the third embodiment of the wide racking body 330, and the manner in which it is fastened to the wide frame member 110, may be analogous to that of the first and second embodiments, with the primary difference between the embodiments being the type and number of bottle supports 333 and the orientation which these bottle supports 333 hold bottles of wine B. In this regard, the third embodiment of a wide racking body 330 provides a customization option for the modular rack assembly built in accordance with the present invention that also uses the wide frame member 110.

It is appreciated that when bottle supports 333 in the form of planar shelves are employed, angular stands may be used to position bottles in a partially upright, angled orientation.

When two discrete combined wide racking bodies 330 and wide frame members 110 are placed side by side, they may be fastened together by a frame coupling mechanism, as described below. A modular racking assembly may be formed of any number of combined racking bodies and frame members (whether wide or narrow), with all of the combined racking bodies and frame members positioned side by side to allow for a desired presentation and jointed together with the frame coupling mechanism.

Referring now to FIGS. 11*a*, 11*b*, 11*c* and 12, a partial view of a wide frame member 110 and a narrow frame member 120 which shows only the four back frame elements for each, namely the frame elements which would be placed against a wall when the wide frame member 110 and narrow frame member 120 are positioned for use, is shown. These figures show a wide frame member 110 and a narrow frame member 120, but it is appreciated that the same arrangement of parts would be employed if coupling two side by side wide frame members or two side by side narrow frame members.

Figure 11A:
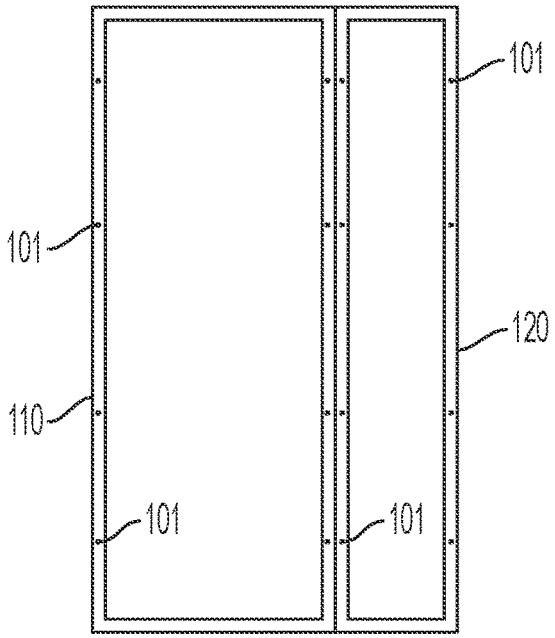
FIG. 11*a* is a front elevational view of a cross section of an adjoining wide frame member and narrow frame member of a modular rack assembly for wine bottles built in accordance with the present invention, showing only the wall adjacent frame elements of the wide frame member and the narrow frame member.
Figure 11B:
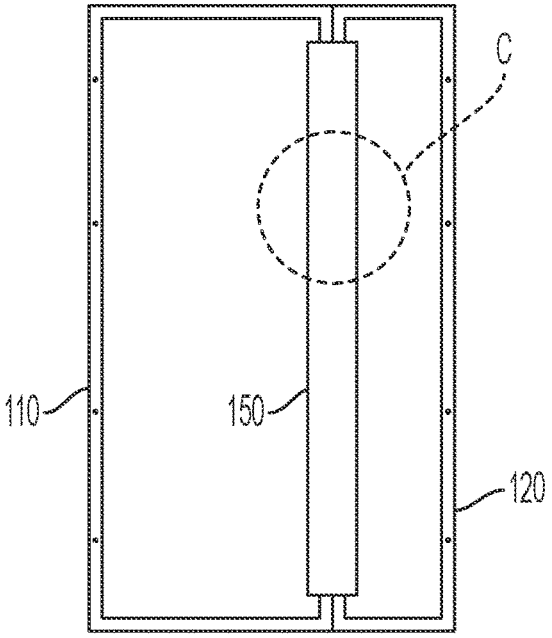
FIG. 11*b* is a front elevational view of a cross section of an adjoining wide frame member and narrow frame member of a modular rack assembly for wine bottles built in accordance with the present invention, showing only the wall adjacent frame elements of the wide frame member and the narrow frame member and a frame coupling mechanism connecting frame elements from the wide frame member and the narrow frame member.
Figure 11C:
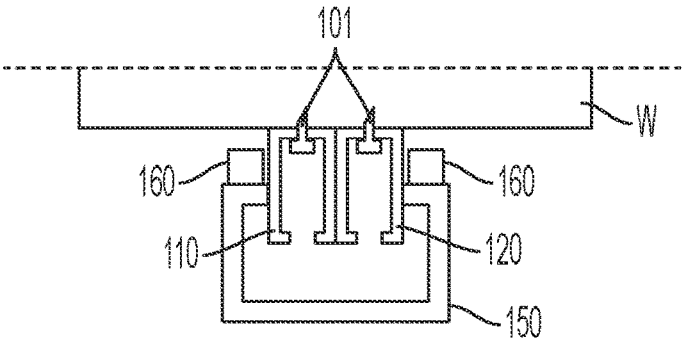
FIG. 11*c* is a top plan view of a cross section an adjoining wide frame member and narrow frame member of a modular rack assembly for wine bottles built in accordance with the present invention, showing cutaway section C of FIG. 11*b*.
Figure 12:
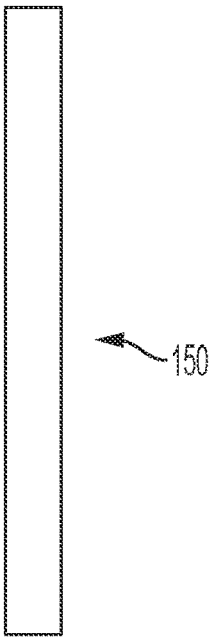
FIG. 12 is a front elevational view of a frame coupling mechanism of a modular rack assembly for wine bottles built in accordance with the present invention.

As illustrated in FIG. 11*a*, the wide frame member 110 and narrow frame member 120 may be positioned for use side by side against a wall, with their respective the four back frame elements against the wall. The four back frame elements may include a plurality of elongated fasteners 101, such as screws, inserted into apertures in the frame elements to allow for secure attachment to such a wall.

As illustrated in FIGS. 11*b*, 11*c*, 12 and 13, the wide frame member 110 and narrow frame member 120 may be coupled together with an elongated frame coupling mechanism 150, which may be defined as a rigid frame sleeve size to frictionally fit over the side by side frame elements of two different frame members. It is contemplated that the frame coupling mechanism 150 would additionally be sized completely cover the front of the frame elements, including in aperture therein, and extend around to the sides of the frame elements, but not extend all the way to the wall W. In this regard, the space between the wall W and the frame coupling mechanism 150 on either side of the side by side frame elements could be used for optional lighting strip 160 as described below.

Figure 13:
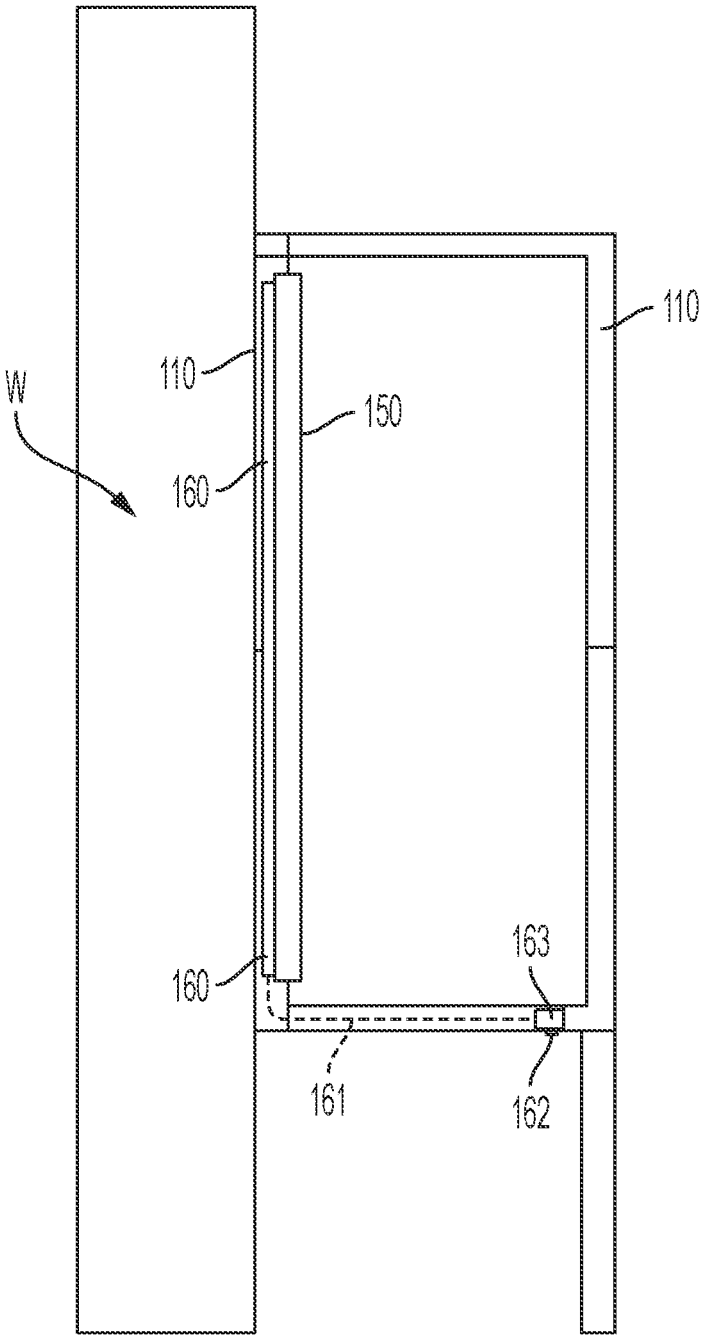
FIG. 13 is a side elevational view of a cross section of a wide frame member of a modular rack assembly for wine bottles built in accordance with the present invention.

As illustrated in FIG. 13, viewing a cross section of the wide frame member 110 from a perspective that allows the the frame element that has the frame coupling mechanism 150 on it to be viewed, allows the optional lighting strip 160 to be seen. In illuminating embodiments of the modular rack assembly, the lighting strip 160 may be positioned adjacent to the frame coupling mechanism 150 such that when the lighting strip 160 is illuminated, a background lighting effect adjacent to the wall W is produced from an integrated source of background light for the modular rack assembly. It is contemplated that the lighting strip 160 may be connected to electrical wiring 161 which extends through frame elements of the wide frame member 110 to a lighting switch 162 and a power source, such as a battery 163. It is further contemplated that any wide frame member or narrow frame member having a frame coupling mechanism 150 may be configured with an integrated source of background light in this manner.

Figure 14:
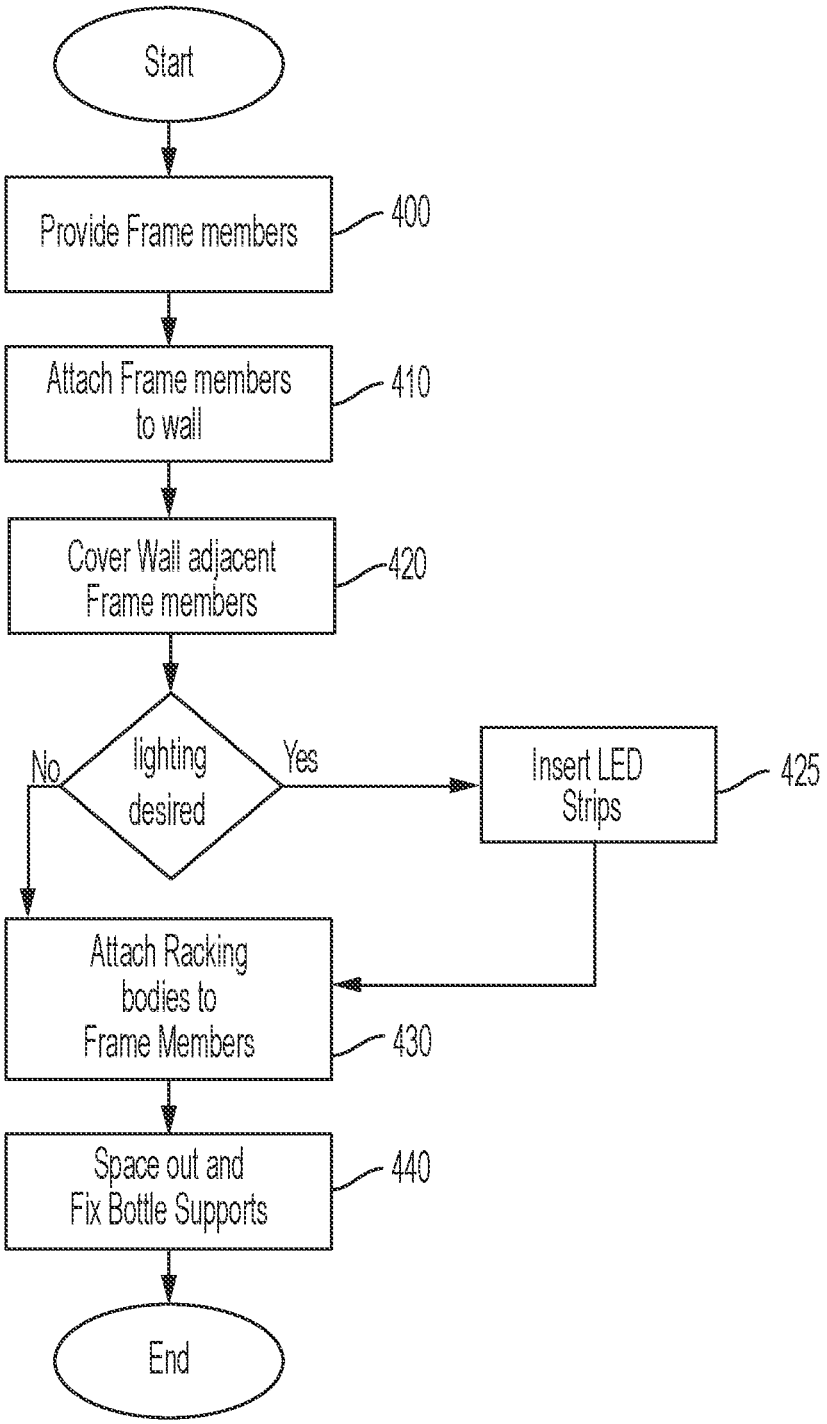
FIG. 14 shows a process for assembling a modular rack assembly for wine bottles built in accordance with the present invention.

The frame elements of a wide frame member 110 or a narrow frame member 120 may be structured as a U channel, with the closed "bottom" of the channel being placed against the wall W and the open "top" of the channel facing away from the wall. The frame elements may alternatively be four sided tubes with aligned apertures in both a front side and a back side, with the back side being the side to be placed against the wall where a fastener will be held and the front side enabling a screwdriver or other tool to access the back side. In any such embodiments, mechanical fasteners can be used to secure the frame elements against a wall W with extending all the way through the entire frame element Referring now to FIG. 14, assembling a modular rack assembly for wine bottles begins with providing a set of frame members at step 400. It is contemplated that the provision of a set of frame members may include providing one or multiple wide frame members, one or multiple narrow frame members, or a combination of any desired number of wide frame member and narrow frame members. The step of providing a set of frame members at step 400 may further include the separate assembly of any or all of the frame members in the set of frame members from a pair of U shaped profile parts, with each of the U shaped profile parts forming either the top half or the bottom half of a given frame member. It is contemplated that if pairs of U shaped profile parts are used to assemble a frame member, the pair of U shaped profile parts may be fixed together with an internal dowel which is frictionally set into the opposing ends of the U shaped profile parts which are to be coupled together. FIGS. 4A, 4B, 5A and 5B illustrate both a wide frame member and a narrow frame member, respectively, which are each formed from two U shaped profile parts with the opposing ends of the U shaped profile parts placed in contact as they are when coupled together.

It is further contemplated that the provision of the set of frame members may include attaching support legs to each frame member in the set of frame members. Each support leg may be attached using a brace. FIGS. 4A, 4B, 5A and 5B illustrate support legs attached to both a wide frame member and a narrow frame member, respectively, with the support legs placed in contact both with the wide frame member and narrow frame member as they are when coupled together.

Once the set of frame members have been provided, the frame members in the set of frame members are then attached to a wall at step 410. Attaching the frame members to the wall may be accomplished by passing a plurality of elongated mechanical fasteners, such as screws, through the frame elements of the relevant frame members which are placed against the wall. As noted above, these wall adjacent frame members may be structured as a U channel, with the open end further away from the wall.

Once the frame members in the set of frame members are attached to the wall, all wall adjacent frame elements which are side by side with a frame element of another frame member, and any wall adjacent frame elements structured as a U channel are covered at step 420. For all wall adjacent frame elements which are side by side with a frame element of another frame member, this is done with the frame coupling mechanism. For the U channels, this may be done by attaching an elongated planar cover to the frame member to substantially enclose the frame member.

It is contemplated that if lighting is desired, then after to step 420, LED strips may be attached next to any installed frame coupling mechanism at step 425. These strips can later be connected to wiring that is to be attached underneath the frame members.

Then, racking bodies which correspond in size to each of the frame members in the set of frame members are attached to each of these frame members at step 430. This step begins with first attaching the upper and lower mounting boards for each racking body to the upper and lower portion of a target frame member, which may be performed using elongated mechanical fasteners, such as screws. The step then entails, for each mounting board set, attaching a plurality of suspension cords to first the upper and then the lower mounting boards. It is contemplated that the suspension cords would be attached at each end to the upper and lower mounting boards though a discrete cord connector and that the upper and lower mounting boards may include integrated metal receiving plates at each location where a suspension cord would be attached. In such an implementation, the metal receiving plates may include an aperture which allows a cord connector to be attached thereto using elongated mechanical fasteners, such as screws.

Once the suspension cords are fixed to the upper and the lower mounting boards, their tautness may be adjusted by operating the cord connectors, which may be defined as sleeve bolts (or screw sleeves).

It is contemplated that the suspension cords, when being attached to the mounting boards, may already have a plurality of bottle supports strung thereon. If not, the plurality of bottle supports must be threaded on prior to attaching the suspension cords to the lower mounting board.

Once the suspension cords are attached to the mounting boards with the plurality of bottle supports thereon, the plurality of bottle supports are spaced out and fixed in place at step 440. The plurality of bottle supports may each be fixed in place with an allen sleeve nut or a stop sleeve.

It is contemplated that if tilted adapters are desired on any of the bottle supports, they can be placed on bottle supports defined as shelves. In such a case, small silicone drops may be added on the shelf bottle support to avoid slippage of the tilted adapter.

If LEDs were added, electrical wiring and switching mechanisms can be attached to the bottom of the lower mounting board once assembly is complete. In this regard, it is contemplated that the LED strips when installed must be positioned to extend to and slightly beyond the bottom of the lower mounting board.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A modular rack assembly, comprising:

at least one frame member having an upper portion, a lower portion, and a plurality of elongated linear frame elements extending between the upper portion and the lower portion;

a racking body having an upper mounting member, a lower mounting member, and a plurality of suspension cords extending vertically between the upper mounting member and the lower mounting member, wherein the racking body is fixed to said at least one frame member with the upper mounting member fastened to the upper portion and the lower mounting member fastened to the lower portion such that each of the suspension cords are taut between the upper mounting member and the lower mounting member; and a plurality of mechanical supports, wherein each of the plurality of mechanical supports is integral with at least one of the plurality of suspension cords and the plurality of mechanical supports are distributed along the plurality of suspension cords on a plurality of horizontal planes.

2. The modular rack assembly of claim 1, additionally comprising at least one lighting element integral with the at least one frame member, wherein the at least one frame element is configured so that light from the at least one lighting element is directed between the upper portion and the lower portion and between at least two of the plurality of elongated linear frame elements.

3. The modular rack assembly of claim 1, wherein the at least one frame member additionally includes a plurality of support legs that separately extend outwardly from a surface on the lower portion that is facing away from the upper portion.

4. The modular rack assembly of claim 1, wherein the racking body is fixed to said at least one frame member with the upper mounting member fastened to a surface on the upper portion that is facing the lower portion and the lower mounting member fastened to a surface on the lower portion that is facing the upper portion.

5. The modular rack assembly of claim 1, wherein each of the plurality of mechanical supports is adapted to support at least one bottle.

6. A modular rack assembly, comprising:

at least one frame member having a rectangular upper portion, a rectangular lower portion, and four elongated linear frame elements extending from each corner of the upper portion to a corresponding corner of the lower portion;

a racking body having an upper mounting member, a lower mounting member, and a plurality of suspension cords extending vertically between the upper mounting member and the lower mounting member, wherein said racking body is fixed to said at least one frame member with the upper mounting member fastened to the upper portion and the lower mounting member fastened to the lower portion such that each of the suspension cords are taut between the upper mounting member and the lower mounting member; and a plurality of mechanical supports, wherein each of the plurality of mechanical supports is integral with at least one of the plurality of suspension cords and the plurality of mechanical supports are distributed along the plurality of suspension cords on a plurality of horizontal planes.

7. The modular rack assembly of claim 6, wherein each of the elongated linear frame elements are hollow.

8. The modular rack assembly of claim 7, additionally comprising at least one lighting element integral with the at least one frame member, disposed inside at least one of the elongated linear frame elements, wherein the elongated linear frame element in which a light is disposed is configured so that light from the at least one lighting element is directed out of the elongated linear frame element to a space between the upper portion and the lower portion and between at least two of the elongated linear frame elements.

9. The modular rack assembly of claim 8, wherein the racking body is fixed to said at least one frame member with the upper mounting member fastened to a surface on the upper portion that is facing the lower portion and the lower mounting member fastened to a surface on the lower portion that is facing the upper portion.

10. The modular rack assembly of claim 9, wherein the at least one frame member additionally includes a pair of support legs that are separately attached to two different corners of the lower portion, each extending outwardly from a surface on the lower portion that is facing away from the upper portion.

11. The modular rack assembly of claim 10, wherein each of the plurality of mechanical supports is adapted to support at least one bottle.

12. A composite modular rack assembly, comprising:

a plurality of frame members having a rectangular prism shape, with each having an elongated rectangular upper portion, an elongated rectangular lower portion, and four elongated linear frame elements extending from each corner of the upper portion to a corresponding corner of the lower portion, wherein each of the plurality of frame members is situated next to another of the plurality of frame members;

a plurality of racking bodies, each having an upper mounting member, a lower mounting member, and a plurality of suspension cords extending vertically between the upper mounting member and the lower mounting member, wherein each of the plurality of racking bodies is fixed to one of the plurality of frame members with, for each racking body and frame member, the upper mounting member fastened to the upper portion and the lower mounting member fastened to the lower portion such that each of the suspension cords are taut between the upper mounting member and the lower mounting member; and a plurality of mechanical supports, wherein each of the plurality of mechanical supports is integral with at least one of the plurality of suspension cords and the plurality of mechanical supports are distributed along the plurality of suspension cords on a plurality of horizontal planes.

13. The modular rack assembly of claim 12, additionally comprising at least one frame coupling mechanism which is configured to simultaneously engage one of the elongated linear frame elements of two side by side frame elements so as to mechanically couple the two side by side frame elements being engaged.

14. The modular rack assembly of claim 13, wherein:

the plurality of frame members include at least one wide frame member and at least one narrow frame member; and the upper portion and the lower portion in the at least one wide frame member, respectively, as well as the upper portion and the lower portion in the at least one narrow frame member, respectively, each include elongated sides, with the elongated sides of the upper portion and of the lower portion in the at least one wide frame member being longer than the elongated sides of the upper portion and of the lower portion in the at least one narrow frame member.

15. The modular rack assembly of claim 14, wherein each of the plurality of racking bodies is sized to correspond to either the at least one wide frame member or the at least one narrow frame member.

16. The modular rack assembly of claim 15, wherein each of the elongated linear frame elements is hollow.

17. The modular rack assembly of claim 16, additionally comprising at least one lighting element integral with the at least one frame member, disposed inside at least one of the elongated linear frame elements, wherein the elongated linear frame element in which a light is disposed is configured so that light from the at least one lighting element is directed out of the elongated linear frame element to a space between the upper portion and the lower portion and between at least two of the elongated linear frame elements.

18. The modular rack assembly of claim 15, wherein the racking body is fixed to said at least one frame member with the upper mounting member fastened to a surface on the upper portion that is facing the lower portion and the lower mounting member fastened to a surface on the lower portion that is facing the upper portion.

19. The modular rack assembly of claim 15, wherein the at least one frame member additionally includes a pair of support legs that are separately attached to two different corners of the lower portion, each extending outwardly from a surface on the lower portion that is facing away from the upper portion.

20. The modular rack assembly of claim 15, wherein each of the plurality of mechanical supports is adapted to support at least one bottle.

* * * * *